US006986506B2

(12) United States Patent
Chapman et al.

(10) Patent No.: US 6,986,506 B2
(45) Date of Patent: Jan. 17, 2006

(54) WATER AERATOR AND METHOD OF USING SAME

(76) Inventors: Teddie C. Chapman, 4912 E. 97th Ave., Tampa, FL (US) 33617; James C. Terry, II, P.O. Box 291993, Tampa, FL (US) 33687

( * ) Notice: Subject to any disclaimer, the term of this patent is extended or adjusted under 35 U.S.C. 154(b) by 0 days.

(21) Appl. No.: 10/427,545

(22) Filed: May 1, 2003

(65) Prior Publication Data

US 2004/0217491 A1 Nov. 4, 2004

(51) Int. Cl.
*B01F 3/04* (2006.01)

(52) U.S. Cl. ..... 261/76; 261/116; 261/DIG. 75
(58) Field of Classification Search ..... 261/76, 261/116, DIG. 75
See application file for complete search history.

(56) References Cited

U.S. PATENT DOCUMENTS

| | | | | | |
|---|---|---|---|---|---|
| 1,491,057 | A | * | 4/1924 | Myers | 417/174 |
| 3,282,227 | A | * | 11/1966 | Nielsen | 417/167 |
| 4,041,981 | A | * | 8/1977 | Davis et al. | 261/64.1 |
| 4,210,534 | A | | 7/1980 | Molvar | 261/76 X |
| 4,308,138 | A | | 12/1981 | Woltman | 261/DIG. 75 |
| 4,313,827 | A | * | 2/1982 | Ratigan et al. | 210/136 |
| 4,333,833 | A | * | 6/1982 | Longley et al. | 210/198.1 |
| 4,710,325 | A | * | 12/1987 | Cramer et al. | 261/24 |
| 4,936,552 | A | | 6/1990 | Rothrock | 261/76 |
| 4,956,080 | A | * | 9/1990 | Josefik | 210/109 |
| 5,098,614 | A | * | 3/1992 | Yeh et al. | 261/64.1 |
| 5,298,198 | A | * | 3/1994 | LaCrosse | 261/76 |
| 5,403,522 | A | * | 4/1995 | Von Berg | 261/36.1 |
| 5,525,242 | A | * | 6/1996 | Kerecz | 210/758 |
| 6,042,089 | A | * | 3/2000 | Klein | 261/76 |
| 6,162,021 | A | * | 12/2000 | Sarshar et al. | 417/174 |
| 6,398,194 | B1 | | 6/2002 | Tsai et al. | 261/36.1 |
| 6,682,057 | B2 | | 1/2004 | La Crosse | 261/76 |

FOREIGN PATENT DOCUMENTS

| | | | |
|---|---|---|---|
| JP | 52-46571 | * | 4/1977 |

* cited by examiner

*Primary Examiner*—Richard L. Chiesa
(74) *Attorney, Agent, or Firm*—Allen, Dyer, Doppelt, Milbrath & Gilchrist, P.A.

(57) ABSTRACT

Air is mixed with water passing through a liquid feed line. An internal nozzle carried within the feed line includes an exit diameter smaller than the diameter of the feed line for creating a liquid stream for mixing with air from a vent line directed into a mixing chamber within the feed line. Through the force of the nozzle, the aerated water is focused into an exit channel having a flat entrance face and an exit bore diameter greater than that of the internal nozzle.

14 Claims, 3 Drawing Sheets

WATER AERATOR AND METHOD OF USING SAME

FIELD OF THE INVENTION

The subject invention pertains to the field of introducing a gas into a liquid, more particularly to the aeration of water.

BACKGROUND OF THE INVENTION

Bodies of water, such as lakes, ponds, canals, pools, and the like suffer from the growth of algae and other undesirable aquatic biota that lead to the depletion of oxygen and other elements required to sustain life therein. In nature, air is generally absorbed in a body of water through the agitation of surface waters resulting from waves and wind. Smaller bodies of water in stagnant areas often do not have this resource and as a result, the life forms living in such bodies of water often succumb to the absence of oxygen or relocate to other more oxygenated areas.

Apparatus for introducing a gas into a liquid is known in the art. Numerous inventors have proposed solutions to these problems. Many of these solutions utilize bubbling aeration pumps or require the use of a plurality of liquid pumps to aerate the water. As discussed more fully below, such systems are inefficient and subject to malfunction.

For example, U.S. Pat. No. 4,210,534 to Molvar discloses a system of mixing a gas with wastewater wherein the gas is injected, under pressure, into the water in a mixing chamber, where it is then discharged. This system requires a pump for the wastewater and an additional pump for pressurizing the air for injection. In addition, the air/wastewater mixture is exited through a tapered exit cylinder wherein the velocity of the mixture is increased.

U.S. Pat. No. 4,308,138 to Woltman describes a method wherein the water passes through a venturi thereby increasing water velocity and further passing through a barrel that acts as an exit chamber. Air is pulled under vacuum introduced into the water stream. The stream of water passes through the barrel; however, it does not come into contact with the sides of the barrel. The barrel then gradually opens where the air is further mixed with the water before it exists the system. This system does not create sufficient suction to saturate the water with air due to the taper nature of the entrance to the exit cylinder. A further drawback to this system is that cavitation does not occur in the exit cylinder. This is because the water/air mixture passing through the barrel does not substantially come into contact with the walls of the exit cylinder.

U.S. Pat No. 4,936,552 to Rothrock utilizes flowing water upstream of a reducing means to create a vacuum thereby pulling ambient air from the atmosphere and introducing it into the flowing wastewater stream. While this system is capable of partial aeration, it cannot attain oxygen levels sufficient to provide the desired results in a lake, pond, canal, pool or the like.

U.S. Pat. No. 6,398,194 to Tsai et al. discloses a water-pressure type aeration device utilizing a powerful water pump, which moves water through a distribution head to a plurality of cavitation housings. The plurality cavitation housings are further in fluid communication with surface air. Where water passes into the cavitation housings, it decreases the pressure therein and pulls a vacuum which, in turn, pulls air from the surface. The air is mixed with water wherein it is then expelled from the apparatus through a downward inclined guide element. All of the aforementioned aeration systems suffer from certain shortcomings, some more serious than others. For example, some require the use of more than one pump or moreover, require the use of more than one type of pump. Any of the deficiencies suffered by these devices can result in losses in efficiency and ultimately result in economic losses. Accordingly, the following disclosure describes improvements in the art of water aeration.

All documents and publications cited herein are incorporated by reference in their entirety, to the extent not inconsistent with the explicit teachings set forth herein.

BRIEF SUMMARY OF THE INVENTION

An apparatus and method for the introduction of a gas into a liquid includes a liquid supply, a liquid feed tube, a reducing means, a vent line, a mixing chamber, and an exit cylinder.

Liquid is supplied under pressure from the liquid supply through the liquid feed tube. As liquid passes through the liquid feed line it is passed through a reducing means where the velocity is increased. The exit of the reducing results in a high speed stream of water narrower than the diameter of the exit cylinder. The water passes through the mixing chamber and enters the exit cylinder. The entry of the water stream into the exit cylinder reduces the internal pressure of the mixing cylinder thereby creating a suction. The suction created results in a vacuum effect on the vent line whereby a gas is pulled through the vent tube (generally in communication with ambient air from the surface) and introduced to the water in the mixing chamber. The water/gas combination is passed through the exit chamber where the water stream is subjected to cavitation as the water/air mixture passes along the walls of the exit cylinder. As the system cavitates the gas is mixed with the liquid to the point where the liquid becomes saturated with the gas. The liquid gas mixture is exited from the exit cylinder where the remaining gas is released in the form of bubbles.

Accordingly, it is an object of the present invention to provide an improved apparatus for the introduction of gas into a liquid.

It is a further object of the present invention to provide an apparatus and method for the aeration of water.

It is a still further object of the present invention to provide an improved water aeration apparatus for lakes, ponds, canals, pools and the like.

Further objects and advantages of the present invention will become apparent by reference to the following detailed disclosure of the invention and appended drawings wherein like reference numbers refer to the same element, component, or feature.

DETAILED DESCRIPTION OF EMBODIMENTS

Figure 1:
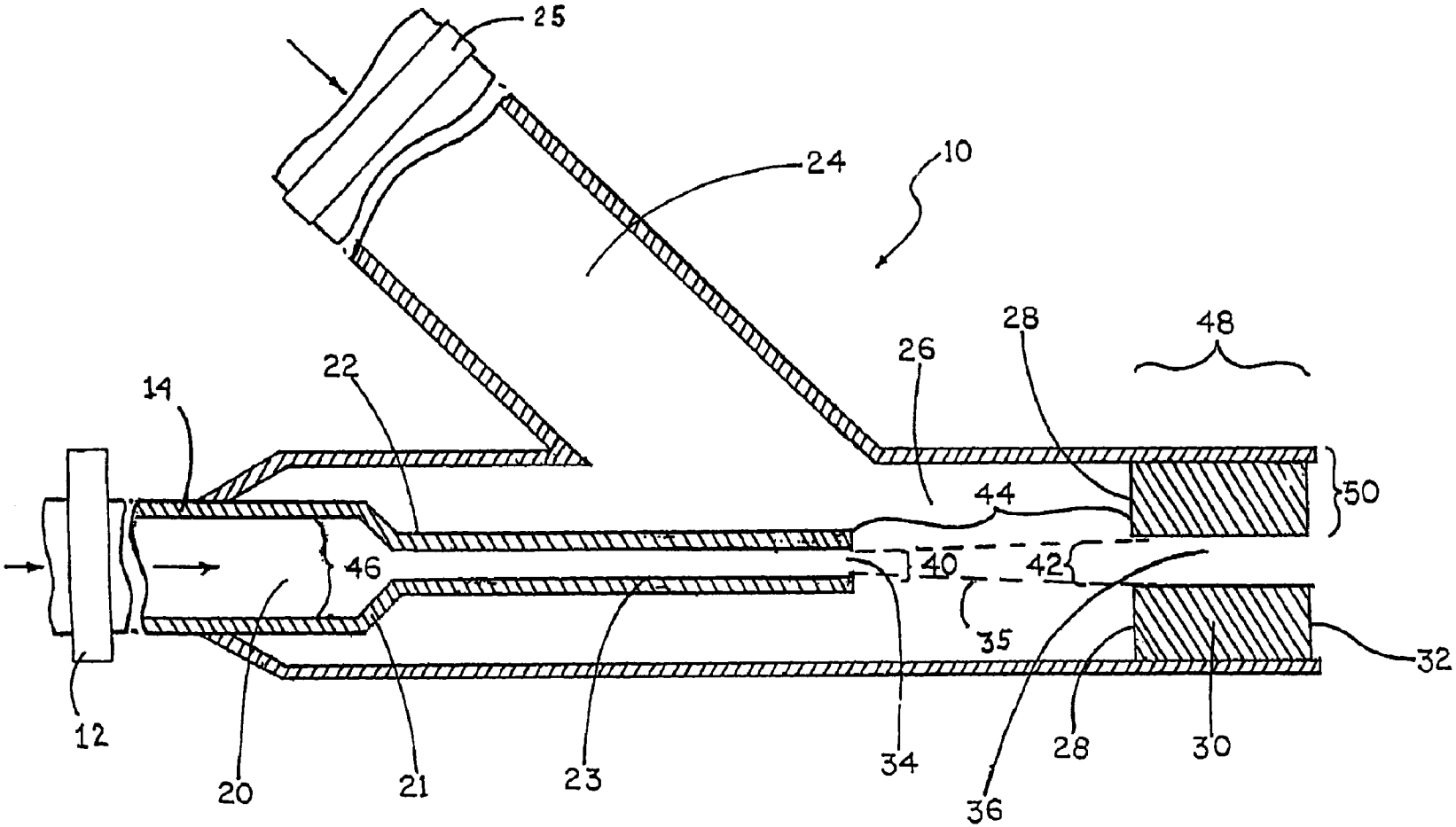
FIG. 1 is a full, sectional view of the apparatus in accordance with the present invention.
Figure 2:
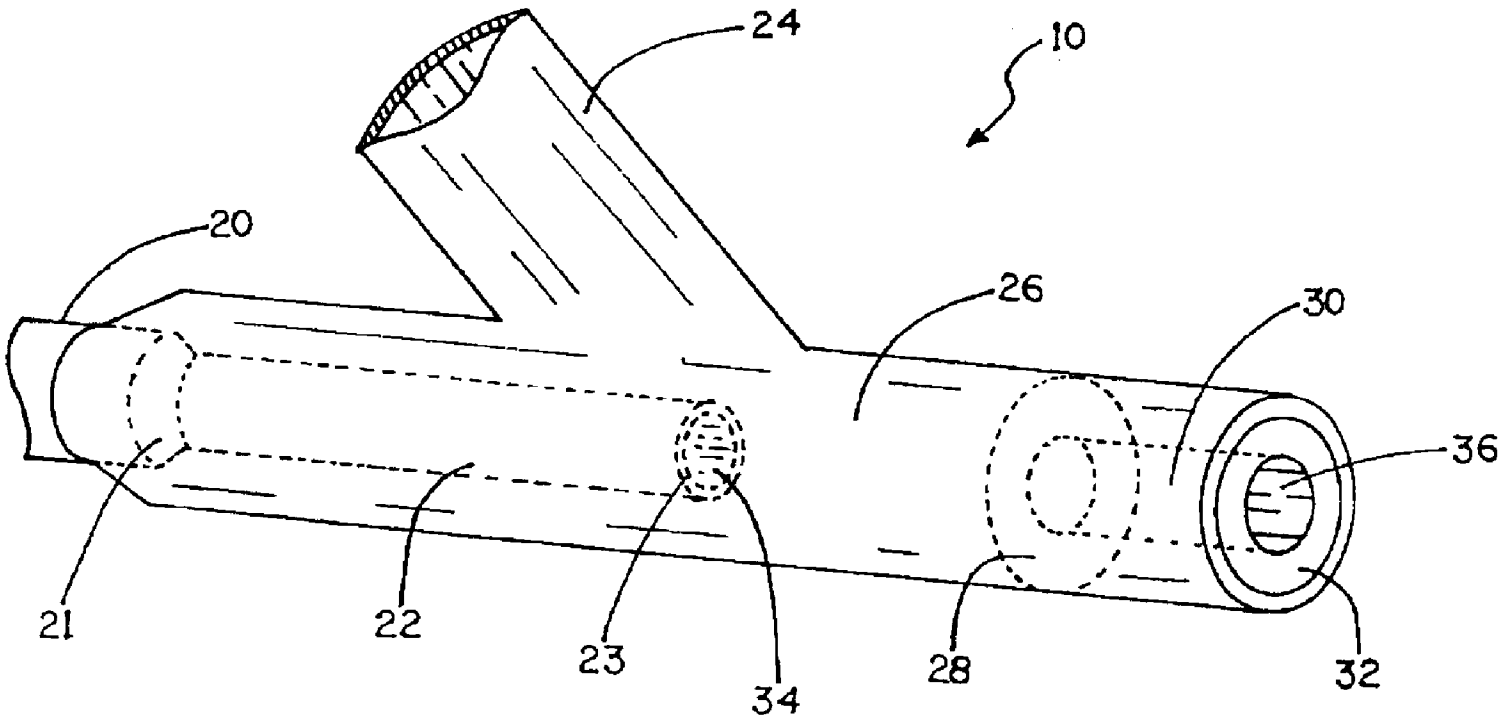
FIG. 2 is a fragmentary perspective view of the apparatus in accordance with the present invention.
Figure 3:
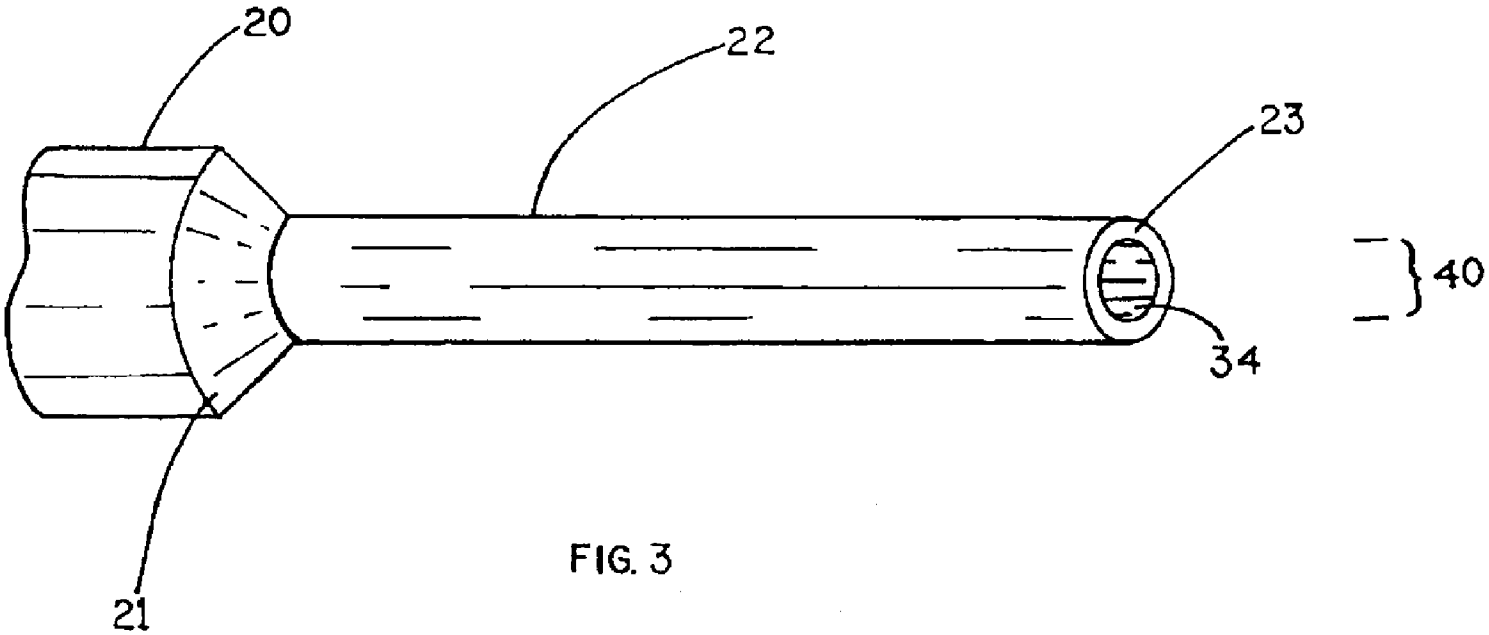
FIG. 3 is a perspective view of the internal nozzle in accordance with the present invention.

Referring now to FIG. 1, an apparatus for the improved aeration of water is illustrated and generally designated by the reference numeral 10.

The apparatus 10 can be utilized either above or below the surface of the liquid into which a gas is to be introduced.

Typically, the apparatus is submerged to a depth at which a gas can be pulled under vacuum through the apparatus. A liquid supply 12, generally a pump or a pressurized storage tank, supplies liquid under pressure through a liquid feed line 20. As will come to the mind of those skilled in the art, the liquid supply 12 may include well known pump styles such as bellows, centrifugal, diaphragm, drum, flexible liner, flexible impeller, gear hand, impeller , immersible, peristaltic poston, progressing cavity, and rotary submersible. The liquid feed line enters into a first end 14 of the apparatus 10 and is connected to an internal nozzle 22 concentrically disposed in the mixing chamber 26 of the apparatus 10.

The internal nozzle 22 generally comprises a reducing means 21 in fluid communication with the feed line 20 at a first end and a cylinder 23 at a second end. The internal nozzle 22 is generally concentrically disposed and terminates in the mixing chamber 26. It is not necessary, however, that the internal nozzle 22 be concentrically disposed in the mixing chamber 26 as it may be disposed in any position in the mixing chamber 26, so long as the liquid stream flowing from the internal nozzle 22 enters the exit channel 36 unobstructed. Any means to reduce the liquid feed line 20 to a point where the internal nozzle exit 34 has a diameter 40 smaller than the diameter 46 of the liquid feed line 20 will suffice (for example, a series of commercially available reducing adapters).

A vent line 24 is connected to and in fluid communication with the mixing chamber 26 at a point more medial of the apparatus 10. The vent line 24 is in fluid communication with the mixing champer 26 at a first end and a gas supply 25, generally ambient air at a second end. It is not necessary that the vent line 24 be in communication with ambient air as one or more gas supplies may also be connected to the vent line 24 so that a gas other than air can be introduced into the liquid.

The apparatus 10 has an exit cylinder 30 in fluid communication with the mixing chamber 26 at a second end. The exit cylinder 30 has an exit cylinder entrance face 28, exit channel 36, and an exit cylinder exit face 32. The exit cylinder entrance face 28 and exit face 32 are both substantially perpendicular to the flow of liquid passing through the apparatus 10. This is critical to achieve the desired suction for efficient operation and saturation of the liquid with the gas.

As liquid passes through the liquid feed line 20 and into the internal nozzle 22, the velocity of the fluid flowing there through is increased.

As the liquid leaves the internal nozzle exit 34, a stream of liquid 35 is created (not shown). The stream of liquid passes through the mixing chamber 26 and into the exit cylinder channel 36. As the liquid passes through the mixing chamber 26, the internal pressure of the mixing chamber 26, is reduced resulting in a vacuum. This in turn creates a vacuum on vent tube 24. The gas, generally ambient air, is pulled from the surface under the vacuum and into the mixing chamber 26. Where it is intially introduced to the liquid. The liquid/gas mixture is then sent into the exit cylinder 30 wherein it is further mixed to the point of saturation. The exit channel 36 can extend distally past exit face 32 or proximally past the entrance face 28 of the exit chamber 30.

As the gas/liquid mixture passes through the exit cylinder channel 36, the mixture comes in contact with the walls of the exit cylinder channel 36 and is subjected to cavitation. This contact occurring between the liquid/gas mixture and the walls of the exit cylinder channel 36 is important to the efficient operation of the apparatus 10. The liquid/gas mixture is then exited from the exit cylinder 30 into the surrounding body of liquid. Excess gas is released in the form of bubbles.

To provide a better understanding of a number of terms used in the specification and claims herein, the following definitions are provided.

The term cavitation, as used herein, is the creation and subsequent implosion of a gas bubble in a liquid low pressure.

The term gas, as used herein, is a form or state of matter in which a material assumes the shape of its container and expands to fill the container, thus having neither definite shape nor volume. Air is included in this definition.

The term liquid, as used herein, is a form of state of matter in which a material occupies a definite volume but has the ability to flow and assume the shape of its container.

The term pump, as used herein, is any apparatus that is capable of supplying a fluid under pressure. The term saturation, as used herein, is the point at which a liquid contains the maximum quantity of a gas that is possible at a given temperature.

Following are examples illustrating procedures for practicing the invention. These examples should be construed to include obvious variations and not limiting.

EXAMPLE 1

In a preferred embodiment, the distance 44 from the exit of the reduction means 34 to the exit cylinder entrance face 28 is greater than the diameter of the exit cylinder 42. In addition, the length of the exit cylinder 30 is greater than the diameter 42 of the exit cylinder 30. It is also desirable that the distance 50 from the inside of the exit channel 36 to the outer edge of the exit cylinder 30 be greater than the diameter 42 of the exit channel 36. It is also important to note that the entrance face 28 of the exit cylinder 30 as well as the exit face 32 of the exit cylinder 30 should be substantially perpendicular to the flow of the liquid stream.

EXAMPLE 2

In an alternative embodiment, the vent line 24 can be connected to an alternative gas source 25. Such an alternative gas source can include pressure pumps or other means whereby a gas is delivered under pressure or otherwise for introduction into the liquid. For example, when used in a pool or other body of water in which chlorination is desired, a chlorine gas supply can be connected in fluid communication with the vent line 24. In the alternative, the chlorine gas supply can be directly connected in fluid communication with the mixing chamber 26 at an alternate entrance. Either embodiment allows for the improved mixture of chlorine gas with water.

EXAMPLE 3

In still another embodiment, the exit channel 36 extends either distally, past the exit face 32 of the exit cylinder 30 or proximally past the entrance face 28 of the exit cylinder 30.

EXAMPLE 4

In a still further embodiment, the internal nozzle 22 is not concentrically disposed in the mixing chamber 26. The internal nozzle 22 may be disposed in any position in the mixing chamber 26 provided the liquid stream passing therefrom enters the exit channel 36 unobstructed.

EXAMPLE 5

In a still further embodiment, the air entering the vent line 24 is filtered by a conventional filter prior to its introduction into the mixing chamber 26.

In yet another embodiment, the vent line 24 is connected to a secondary line in communication with the ambient liquid source. While this embodiment does not allow for a gas/liquid mixture, it does operate as a highly efficient vacuum for pools and the like. As such, a filter or other means to collect debris may be inserted in communication with the secondary line to allow for the collection and removal of such debris.

Inasmuch as the preceding disclosure presents the best mode devised by the inventor for practicing the invention and is intended to enable one skilled in the pertinent art to carry it out, it is apparent that methods incorporating modifications and variations will be obvious to those skilled in the art. As such, it should not be construed to be limited thereby but should include such aforementioned obvious variations and be limited only by the spirit and scope of the following claims.

We claim:

1. An apparatus for introducing a gas into a liquid comprising:

a liquid feed line in fluid communication with a liquid supply, wherein said liquid supply provides a pressurized liquid flow therethrough;

an internal nozzle attached to said liquid feed line, wherein said internal nozzle has an exit diameter smaller than a diameter of said liquid feed line, thus causing the liquid flowing therethrough to increase velocity and create a stream;

a mixing chamber in fluid communication with a vent line proximate a termination of said internal nozzle; and an exit cylinder in fluid communication with said mixing chamber, said exit cylinder having an entrance face and an exit face, and channel through which the stream passes, said channel having a substantially constant diameter greater than the exit diameter of said internal nozzle, wherein the entrance face and the exit face of said exit cylinder are substantially perpendicular to the flow of liquid from said internal nozzel, and wherein a distance from an exit of said internal nozzle to the entrance face of said exit cylinder is greater that the exit cylinder diameter but less than the exit cylinder channel length.

2. The apparatus of claim 1 wherein said exit cylinder extends past the exit face of the apparatus.

3. The apparatus of claim 1 wherein said internal nozzle comprises a series of reduction adapters.

4. The apparatus of claim 1 wherein said liquid supply comprises a pump.

5. The apparatus of claim 4 wherein said liquid supply is a pump selected from the group consisting of: bellow; centrifugal; diaphragm; drum; flexible liner; flexible impeller; gear hand; impeller; immersible; peristaltic piston; progressing cavity; and rotary submersible.

6. An apparatus for aerating water comprising:

a pump;

a liquid feed line in fluid communication with said pump, wherein said pump provides a pressurized liquid flow therethrough;

an internal nozzle attached to said liquid feed line, wherein said internal nozzle has an exit diameter smaller than the diameter of said liquid feed line, thus causing the liquid flowing therethrough to increase velocity and create a stream;

a mixing chamber in fluid communication with a vent line proximate a termination of said internal nozzle; and an exit cylinder in fluid communication with said mixing chamber, said exit cylinder having an entrance face and an exit face, the exit cylinder further having a channel through which the liquid stream passes, said channel having a substantially constant diameter greater than the exit diameter to said internal nozzle, and wherein the entrance face and the exit face of said exit cylinder are substantially perpendicular to the flow of liquid from said liquid feed, and wherein a distance from an exit of said internal nozzle to the entrance face of said exit cylinder is greater that the exit cylinder diameter but less than the exit cylinder channel length.

7. The apparatus of claim 6, wherein said pump is selected from the group consisting of: bellow; centrifugal; diaphragm; drum; flexible liner; flexible impeller; gear hand; impeller; immersible; peristaltic piston; progressing cavity; and rotary submersible.

8. The apparatus of claim 6 wherein said exit cylinder extends past the exit face of the apparatus.

9. The apparatus of claim 6 wherein said internal nozzle comprises a series of reduction adapters.

10. A method of introducing a gas into a liquid, the method comprising:

supplying a liquid from a liquid supply through a liquid feed line in fluid communication with said liquid supply, wherein said liquid supply provides a pressurized liquid flow there through;

passing said liquid flow through an internal nozzle attached to said liquid feed line, wherein said internal nozzle has an exit diameter smaller than the diameter of said liquid feed line thus causing the liquid flowing there through to increase velocity and create a stream;

introducing said stream into a mixing chamber in fluid communication with a vent line, wherein said stream initially mixes with a gas from said vent line forming a liquid/gas mixture;

introducing said liquid/gas mixture to an exit cylinder in fluid communication with said mixing chamber, said exit cylinder having an entrance face and an exit face generally perpendicular to the flow of said liquid/gas mixture, said exit cylinder having a channel including a substantially constant diameter through which channel the stream passes and becomes subject to cavitation, said channel having a diameter greater than the exit to said internal nozzle, and wherein the entrance face and the exit face of said exit cylinder are substantially perpendicular to the flow of liquid from said internal nozzle, wherein said liquid/gas mixture is then exited from the apparatus into a surrounding body of liquid.

11. The method of claim 10 wherein said exit cylinder extends past the exit face of the apparatus.

12. The method of claim 10 wherein said internal nozzle comprises a series of reduction adapters.

13. The method of claim 10 wherein said liquid supply comprises a pump.

14. The method of claim 13 wherein said pump is selected from the group consisting of: bellow; centrifugal; diaphragm; drum; flexible liner; flexible impeller; gear hand; impeller; immersible; peristaltic piston; progressing cavity; and rotary submersible.

* * * * *